US012527987B2

(12) United States Patent
Hao

(10) Patent No.: US 12,527,987 B2
(45) Date of Patent: Jan. 20, 2026

(54) MODULAR FREE WEIGHT APPARATUS

(71) Applicant: PRCTZ LLC, Allen, TX (US)

(72) Inventor: Szu-Chia Hao, Allen, TX (US)

(73) Assignee: PRCTZ LLC, Allen, TX (US)

( * ) Notice: Subject to any disclaimer, the term of this patent is extended or adjusted under 35 U.S.C. 154(b) by 123 days.

(21) Appl. No.: 18/384,313

(22) Filed: Oct. 26, 2023

(65) Prior Publication Data

US 2025/0090897 A1 Mar. 20, 2025

Related U.S. Application Data

(60) Provisional application No. 63/539,473, filed on Sep. 20, 2023.

(51) Int. Cl.
*A63B 21/00* (2006.01)
*A63B 21/072* (2006.01)

(52) U.S. Cl.
CPC ..... *A63B 21/4035* (2015.10); *A63B 21/072* (2013.01)

(58) Field of Classification Search
CPC ..... A63B 21/072; A63B 21/0728; A63B 21/4035
See application file for complete search history.

(56) References Cited

U.S. PATENT DOCUMENTS 6,887,189 B2 * 5/2005 Schiff ..... A63B 21/0728 482/107
9,126,079 B2 9/2015 Jordan
9,149,680 B2 * 10/2015 Thompson ..... A63B 21/072
10,744,366 B1 * 8/2020 Sorin ..... A63B 21/4035
11,752,385 B2 * 9/2023 Abbott ..... A63B 21/0726 482/106
11,911,648 B2 * 2/2024 Dickstein ..... A63B 21/0722
D1,054,508 S * 12/2024 Abbott ..... A63B 21/0726 D21/679
12,220,608 B2 * 2/2025 Smith ..... A63B 21/0726
2009/0192027 A1 7/2009 Parker
2011/0111929 A1 * 5/2011 Allison ..... A63B 21/072 482/93
2011/0173778 A1 * 7/2011 Wales ..... B25G 3/20 16/426
2011/0177922 A1 * 7/2011 Selinger ..... A63B 21/0724 482/107

(Continued)

OTHER PUBLICATIONS

Jayflex Hyperbell Bundle: Bar, Kettlebell. Product Description [online]. Jayflex Fitness [retrieved on Dec. 7, 2022]. Retrieved from the Internet: <https://www.jayflexfitness.com/products/hyperbell-bundle-bar-kettlebell>.

(Continued)

*Primary Examiner* — Joshua Lee
(74) *Attorney, Agent, or Firm* — Sul Lee

(57) ABSTRACT

A modular free weight apparatus is configured for being removably engageable with at least one free weight for allowing a user to engage in a wide variety of fitness-related exercises. In at least one embodiment, an at least one collar portion is sized and configured for removable engagement about an elongate bar portion of the at least one free weight, the collar portion providing a first collar half hingedly engaged with an opposing second collar half via an at least one collar hinge.

18 Claims, 9 Drawing Sheets

(56) References Cited

U.S. PATENT DOCUMENTS

| | | | | |
|---|---|---|---|---|
| 2012/0252641 | A1* | 10/2012 | Odneal | A63B 21/072 482/108 |
| 2014/0024506 | A1* | 1/2014 | Vixathep | A63B 21/0726 482/108 |
| 2022/0339487 | A1* | 10/2022 | Dickstein | A63B 21/0722 |
| 2022/0355153 | A1* | 11/2022 | Abbott | A63B 21/0722 |

OTHER PUBLICATIONS

Les Mills Barbell Set. Product Description [online]. Les Mills United States Trading Inc., 2021 [retrieved on Dec. 7, 2022]. Retrieved from the Internet: <https://shop.lesmills.com/US/smartbar-weight-set-bar?utm_source=google_shopping&gclid=Cj0KCQiAvqGcBhCJARIsAFQ5ke74uyl2FTDSXpHb7qrgy2tw3avPujPyQEwu4-pl9cQhSVBP71c0-lwaAnjkEALw_wcB&gclsrc=aw.ds>.

Bowflex—SelectTech 2080 Barbell with Curl Bar—Black. Product Description [online]. Nautilus Inc. [retrieved on Dec. 7, 2022]. Retrieved from the Internet: <https://www.bestbuy.com/site/bowflex-selecttech-2080-barbell-with-curl-par-black/6423481.p?skuId=6423481&ref=212&loc=1&ref=212&loc=1&gclid=Cj0KCQiAvqGcBhCJARIsAFQ5ke5_rJOatvGDQ4p4tTkJJBoNGvwF6wjZCQQvfPDHJDM4eZDDWYFfSLYaAIOYEALw_wcB&gclsrc=aw.ds>.

* cited by examiner

MODULAR FREE WEIGHT APPARATUS

RELATED APPLICATIONS

This application claims priority and is entitled to the filing date of U.S. provisional application Ser. No. 63/539,473, filed on Sep. 20, 2023. The contents of the aforementioned application are incorporated herein by reference.

BACKGROUND

The subject of this patent application relates generally to fitness devices, and more particularly to a modular weight apparatus, and associated methods of use, capable of being selectively arranged and configured for allowing a user to engage in a wide variety of fitness-related exercises.

Applicant(s) hereby incorporate herein by reference any and all patents and published patent applications cited or referred to in this application.

By way of background, free weights—i.e., weights that are capable of being freely moved in any desired range of motion, as opposed to weight machines that restrict range of motion—traditionally take on a variety of configurations—e.g., dumbbells, kettlebells, barbells, etc.—so as to better lend themselves to particular types of fitness-related exercises. Thus, in order to perform a relatively wider variety of exercises, a user will typically require multiple types of free weights, in addition to different weight amounts for each such free weight—i.e., a plurality of each type of free weight. However, free weights can be expensive, such that the ability for a user to possess all of the free weights needed to perform their desired exercises can quickly become cost-prohibitive. Additionally, such quantities of free weights can require more space than the user is able to accommodate. As such, there remains a need for an apparatus capable of being selectively arranged and configured for allowing a user to engage in a wide variety of fitness-related exercises while also reducing the overall cost to the user and minimizing the space required to use and store the apparatus.

Aspects of the present invention fulfill these needs and provide further related advantages as described in detail below.

It should be noted that the above background description includes information that may be useful in understanding aspects of the present invention. It is not an admission that any of the information provided herein is prior art or relevant to the presently claimed invention, or that any publication specifically or implicitly referenced is prior art.

SUMMARY

Aspects of the present invention teach certain benefits in construction and use which give rise to the exemplary advantages described below.

The present invention solves the problems described above by providing a modular free weight apparatus configured for being removably engageable with at least one free weight for allowing a user to engage in a wide variety of fitness-related exercises. In at least one embodiment, at least one collar portion is sized and configured for removable engagement about an elongate bar portion of the at least one free weight, each collar portion providing a first collar half hingedly engaged with an opposing second collar half via an at least one collar hinge, thereby allowing the second collar half to pivot relative to the first collar half for selectively moving between one of an open position— wherein a free edge of the second collar half is pivoted away from a corresponding free edge of the first collar half—and a closed position—wherein the free edge of the second collar half is pivoted into substantially abutting contact with the corresponding free edge of the first collar half. The first collar half and second collar half cooperate to define a substantially tubular collar channel extending longitudinally through the collar portion when the collar portion is in the closed position, the collar channel sized and configured for removably receiving the bar portion of the at least one free weight therewithin.

According to an embodiment, each collar portion further provides at least one locking mechanism configured for preventing the collar portion from unintentionally moving out of the closed position.

According to an embodiment, a handle portion provides a grip portion and an at least one engagement shaft configured for engagement with the at least one collar portion.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

Figure 1:
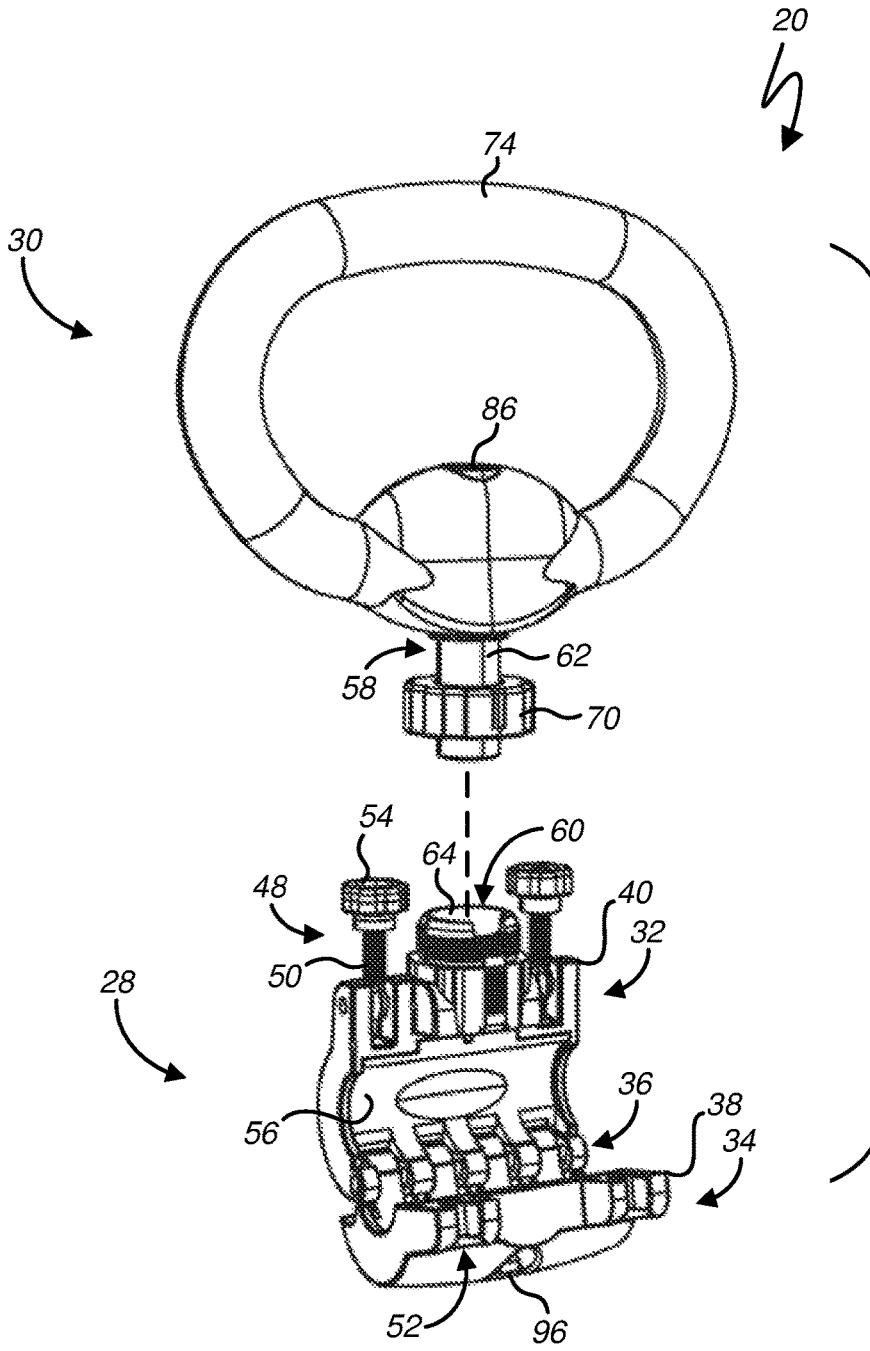
FIG. 1 is an exploded view of an exemplary modular free weight apparatus, in accordance with at least one embodiment.
Figure 2:
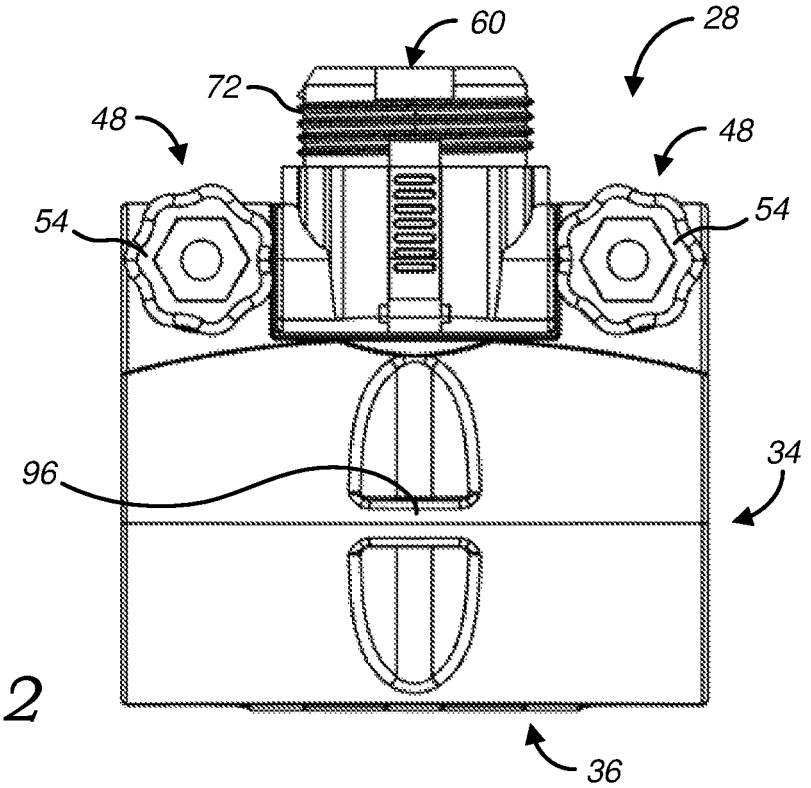
FIG. 2 is a front elevational view of an exemplary collar portion of the apparatus, in accordance with at least one embodiment.
Figure 3:
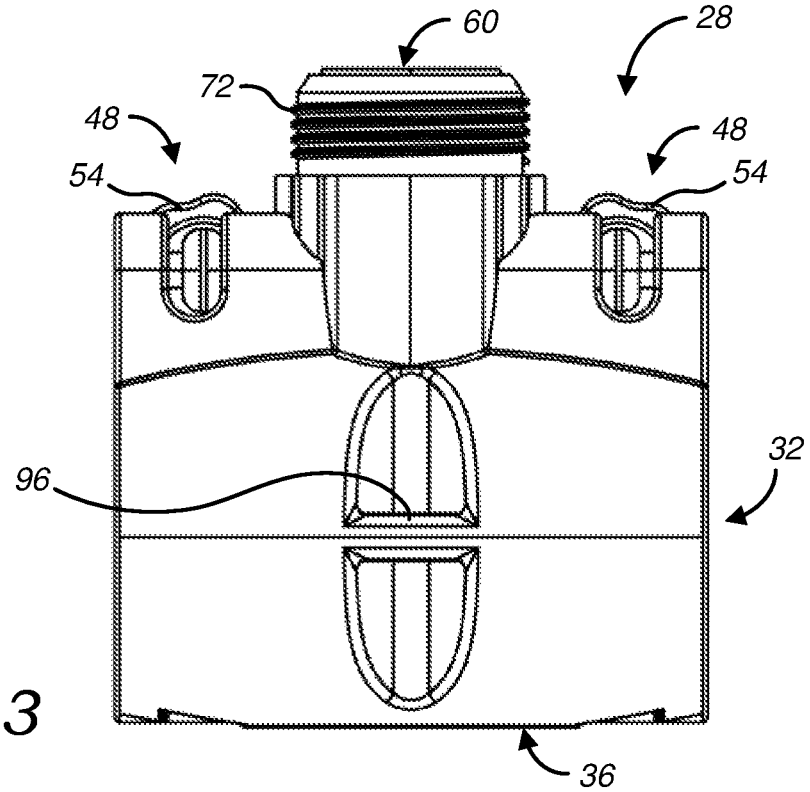
FIG. 3 is a rear elevational view thereof, in accordance with at least one embodiment.
Figure 4:
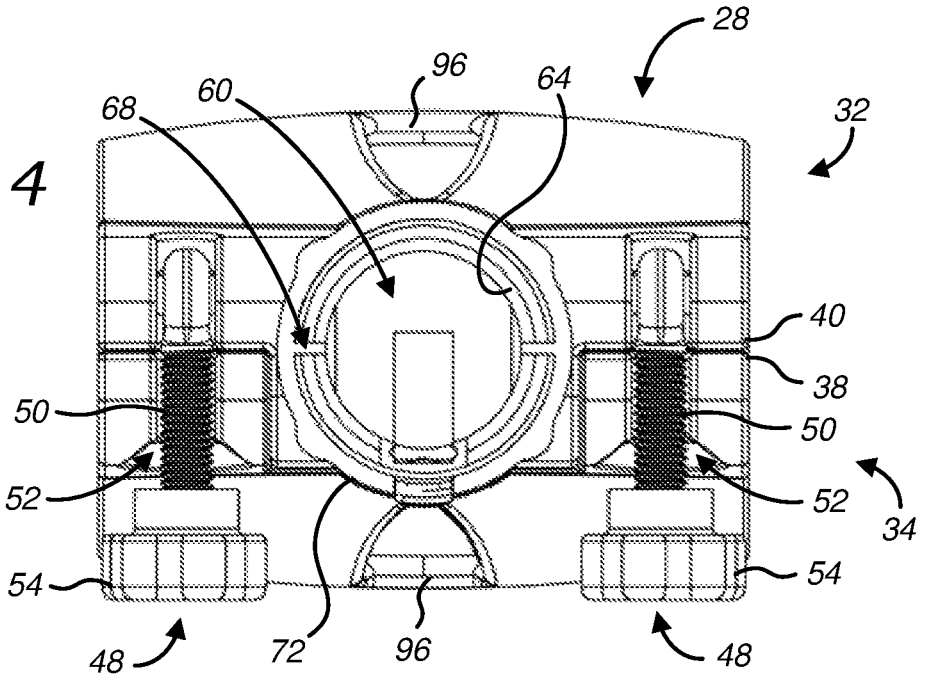
FIG. 4 is a top plan view thereof, in accordance with at least one embodiment.
Figure 5:
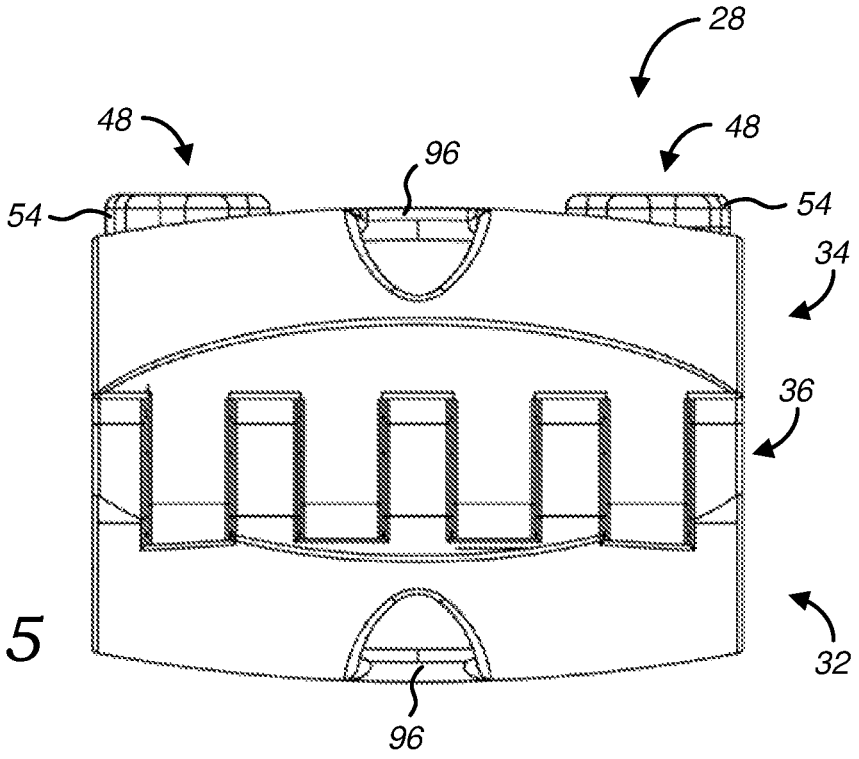
FIG. 5 is a bottom plan view thereof, in accordance with at least one embodiment.
Figure 10:
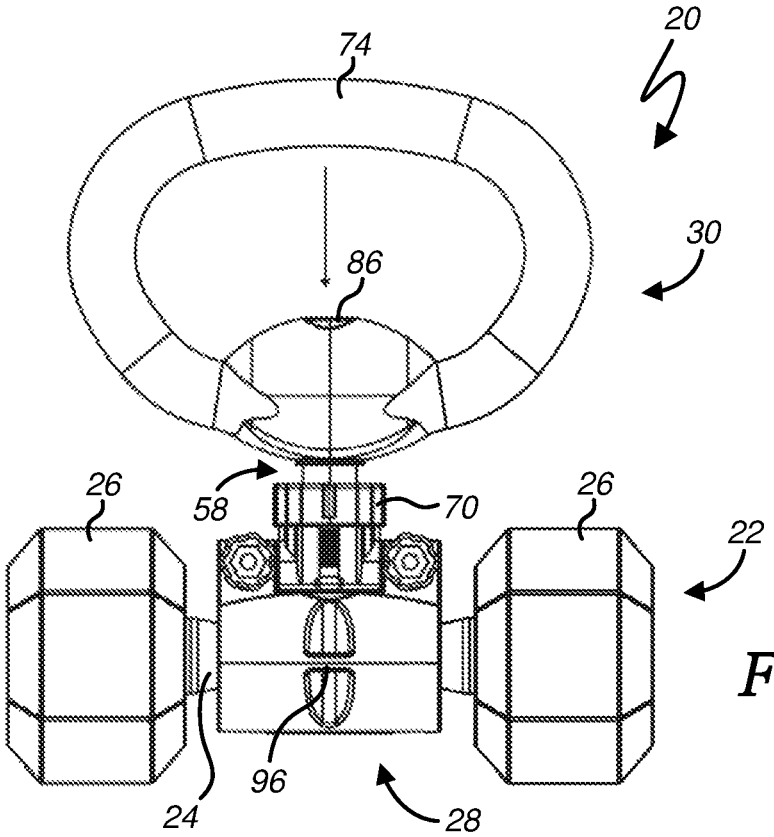
FIG. 10 is a front elevational view thereof, showing the collar portion engaged with an exemplary free weight, with an exemplary handle portion of the apparatus in a first rotational orientation, in accordance with at least one embodiment.
Figure 11:
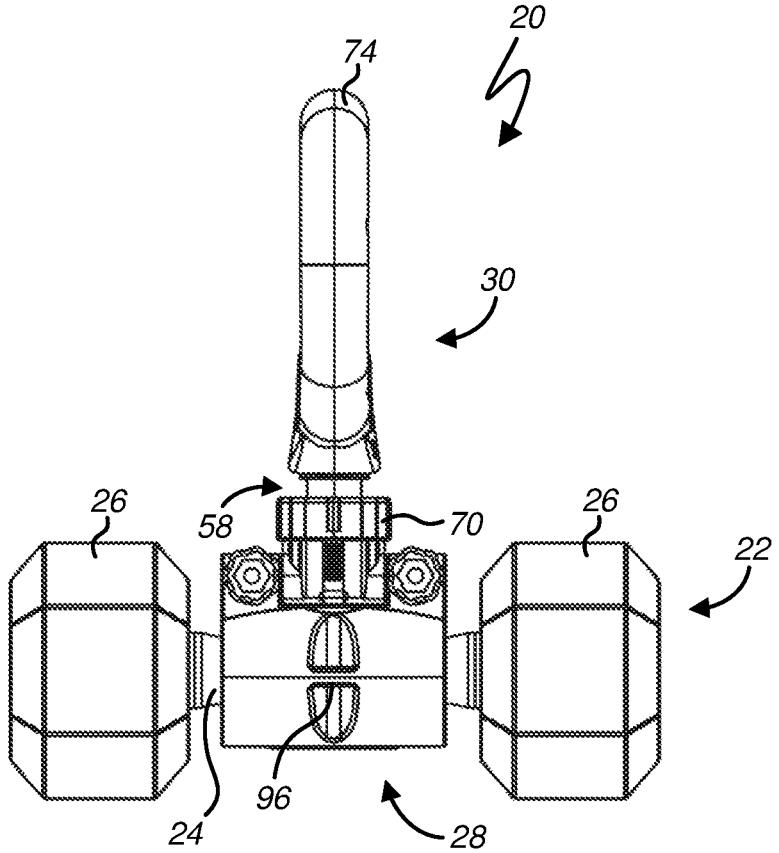
FIG. 11 is a further front elevational view thereof, showing the collar portion engaged with an exemplary free weight, with the handle portion of the apparatus in a second rotational orientation, in accordance with at least one embodiment.

Turning now to FIG. 1, there is shown an exploded view of an exemplary modular free weight 22 apparatus 20 configured for being removably engageable with at least one free weight 22 (FIG. 10), in accordance with at least one embodiment. In that regard, it should be noted that while an exemplary free weight 22 is depicted in the drawings for illustrative purposes, the apparatus 20 is capable of being used in connection with virtually any other type of free weight 22 (now known or later developed) comprising an elongate bar portion 24—for example, a dumbbell which has the elongate bar portion 24 extending between opposing weighted ends 26 having a relatively larger diameter than the bar portion 24.

With continued reference to FIG. 1, in at least one embodiment, the apparatus 20 provides an at least one collar portion 28 sized and configured for removable engagement about the bar portion 24 of the free weight 22, and a handle portion 30 configured for engagement (removable or permanent) with the collar portion 28. In at least one embodiment, as best illustrated in FIGS. 1-6, the collar portion 28 provides a first collar half 32 hingedly engaged with an opposing second collar half 34 via an at least one collar hinge 36, thereby allowing the second collar half 34 to pivot relative to the first collar half 32. Accordingly, in such embodiments, the collar portion 28 is capable of moving between one of an open position (FIG. 1)—wherein a free edge 38 of the second collar half 34 (opposite the at least one collar hinge 36) is pivoted away from a corresponding free edge 40 of the first collar half 32—and a closed position (FIG. 6)—wherein the free edge 38 of the second collar half 34 is pivoted into substantially abutting contact with the corresponding free edge 40 of the first collar half 32. Additionally, in at least one embodiment, the first collar half 32 and second collar half 34 cooperate to define a substantially tubular collar channel 42 extending longitudinally through the collar portion 28 when the collar portion 28 is in the closed position. As discussed further below, the collar channel 42 is sized and configured for removably receiving the bar portion 24 of the free weight 22 therewithin during use of the apparatus 20. According to an embodiment, the collar channel 42 may have an inner diameter that is substantially the same as or relatively larger than an outer diameter of the bar portion 24 of the free weight 22. Additionally, the collar channel 42 (along with the collar portion 28 itself) has a length that is relatively shorter than a length of the bar portion 24 of the free weight 22, thereby allowing the collar portion 28 to be positioned substantially between the opposing weighted ends 26 of the free weight 22.

Figure 7:
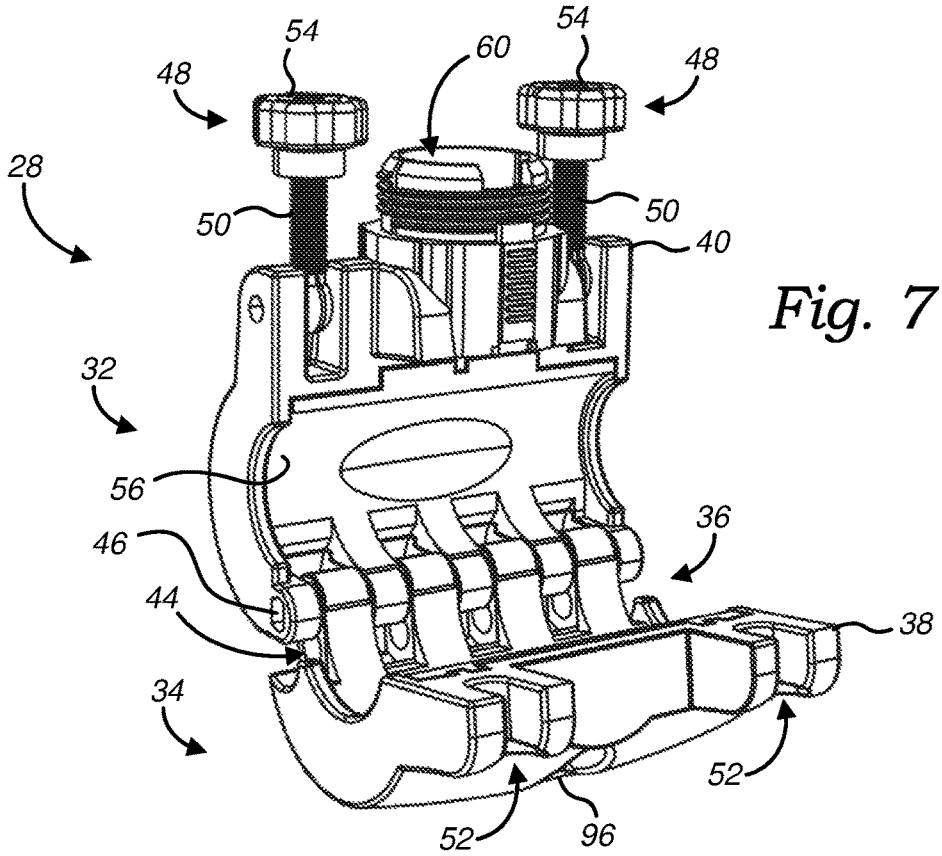
FIG. 7 is a perspective view thereof, showing the collar portion in a first open position, in accordance with at least one embodiment.
Figure 8:
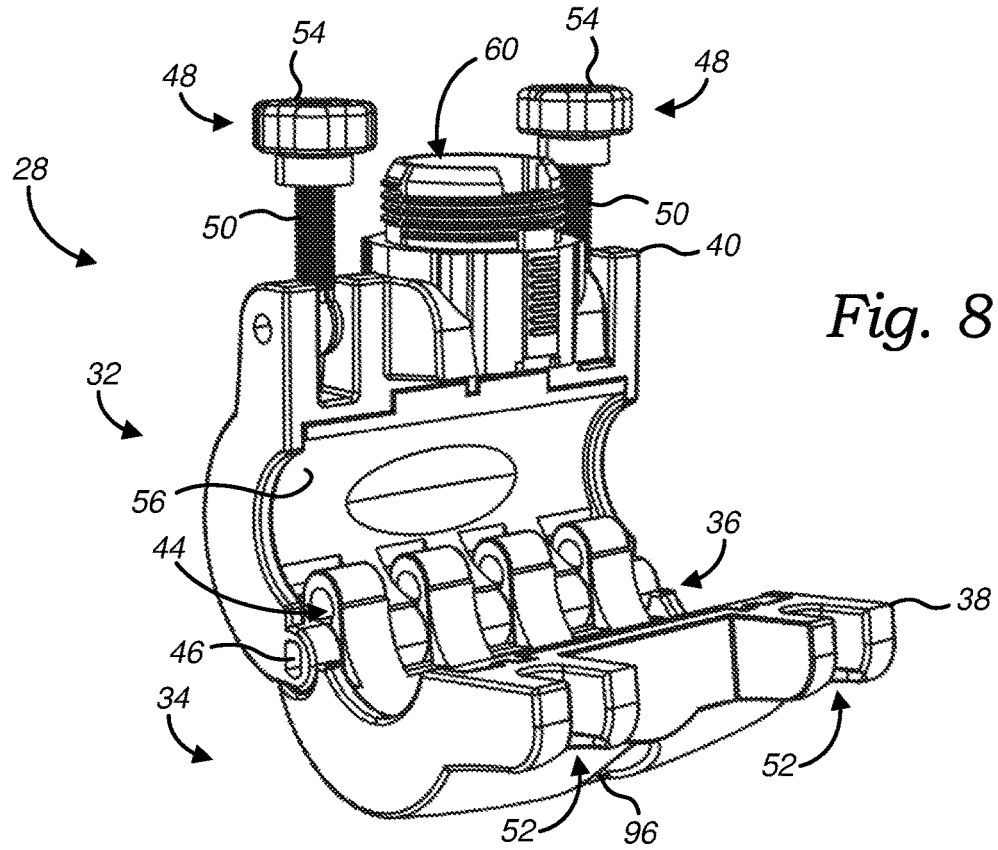
FIG. 8 is a further perspective view thereof, showing the collar portion in a second open position, in accordance with at least one embodiment.
Figure 9:
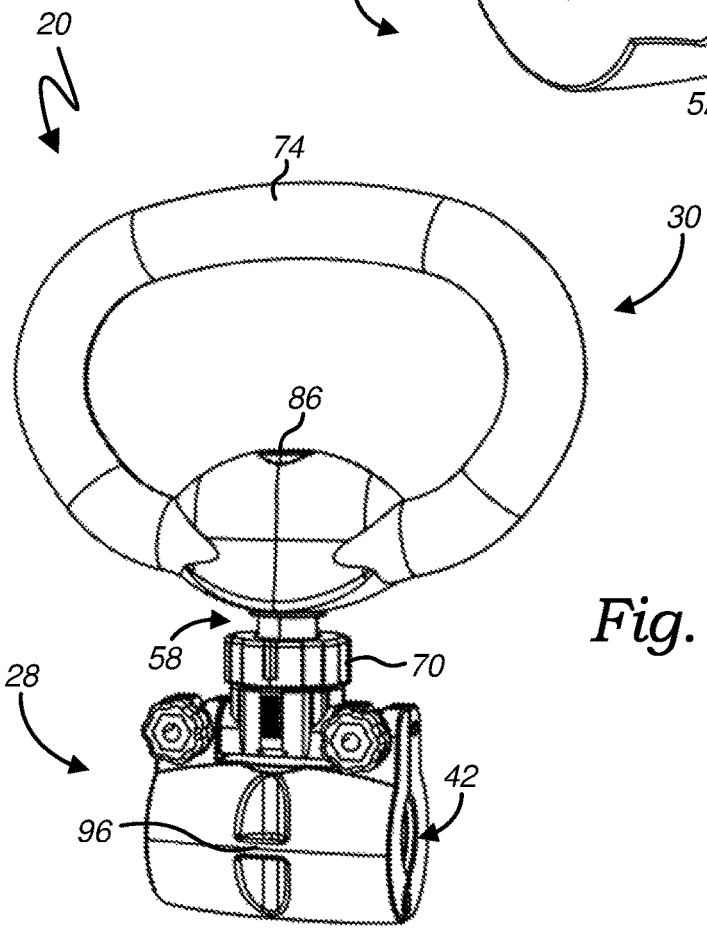
FIG. 9 is a perspective view of the apparatus, in accordance with at least one embodiment.

In at least one embodiment, the at least one collar hinge 36 is configured for allowing the inner diameter of the collar channel 42 to be selectively adjustable so as to accommodate a range of different free weights 22 having bar portions 24 of varying outer diameters. In at least one such embodiment, as best illustrated in FIGS. 7 and 8, the at least one collar hinge 36 provides an at least one elongate hinge slot 44 through which a corresponding hinge pin 46 transversely extends, such that the second collar half 34 pivots about the hinge pin 46. The hinge pin 46 is capable of slidably moving along a length of the hinge slot 44 which, in turn, moves the pivot point for the second collar half 34 relative to the first collar half 32, thereby altering the inner diameter of the collar channel 42 when the collar portion 28 is moved into the closed position. In further embodiments, any other mechanism (now known or later developed) capable of allowing the inner diameter of the collar channel 42 to be selectively adjustable may be substituted.

In that regard, it should be noted that while certain embodiments of the apparatus 20 are depicted in the accompanying drawings and described herein for illustrative purposes, in further embodiments, the apparatus 20 (along with each of the components described herein—including the collar portion 28 and handle portion 30) may take on any other sizes, shapes, dimensions, configurations and/or quantities now known or later developed—dependent at least in part on the context in which the apparatus 20 is to be used—so long as the apparatus 20 is capable of substantially carrying out the functionality described herein.

Figure 6:
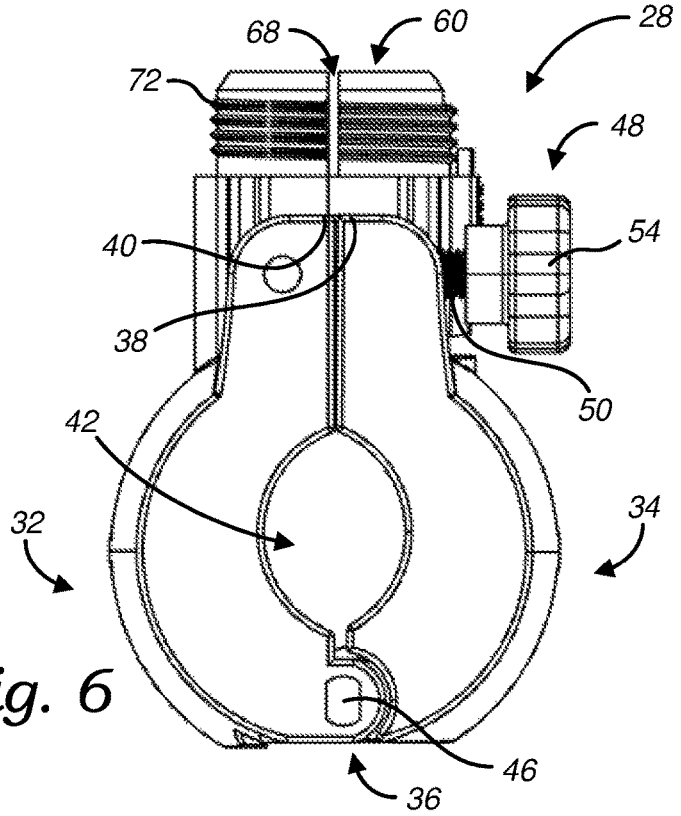
FIG. 6 is a side elevational view thereof, in accordance with at least one embodiment.

In at least one embodiment, the collar portion 28 further provides at least one locking mechanism 48 configured for preventing the collar portion 28 from unintentionally moving out of the closed position. In at least one such embodiment, as best illustrated in FIGS. 1, 4, 7 and 8, the at least one locking mechanism 48 is at least one latch 50 pivotally engaged with one of the first collar half 32 and second collar half 34, with each of the at least one latch 50 being configured for selectively pivoting into a corresponding at least one slot 52 provided by the other of the first collar half 32 and second collar half 34, thereby maintaining the free edge 38 of the second collar half 34 in substantially abutting contact with the corresponding free edge 40 of the first collar half 32, as illustrated in FIG. 6. Though not illustrated, in at least one embodiment in which multiple locking mechanisms 48 are provided, at least one latch 50 may be pivotally engaged with the first collar half 32 (with the corresponding slot 52 for said latch 50 being provided by the second collar half 34), and at least one other latch 50 may be pivotally engaged with the second collar half 34 (with the corresponding slot 52 for said latch 50 being provided by the first collar half 32). In at least one embodiment, each of the at least one locking mechanism 48 is positioned on the same one of the first collar half 32 and second collar half 34. In at least one embodiment, the latch 50 has a threaded outer surface, and a terminal end of the latch 50 provides a threadably engaged tightening knob 54 configured for being selectively tightened against the corresponding slot 52 when the latch 50 is positioned therewithin, thereby assisting to prevent the latch 50 from becoming unintentionally disengaged from the slot 52 during use of the apparatus 20. In further embodiments, any other mechanism (now known or later developed) capable of preventing the collar portion 28 from unintentionally moving out of the closed position may be substituted.

In at least one embodiment, the collar portion 28 is constructed out of one or more of plastic, rubber, and metal materials. Additionally, in at least one embodiment, an inner surface 56 of the collar channel 42 provides a durable, high-friction material (such as gel or rubber, for example) configured for creating a more secure engagement between the collar channel 42 and the handle portion 30 of the free weight 22. In further embodiments, the collar portion 28 may be constructed out of any other materials (now known or later developed) so long as the apparatus 20 is capable of substantially carrying out the functionality described herein.

As noted above, the apparatus 20 provides a handle portion 30 configured for engagement (removable or permanent) with the collar portion 28. In at least one embodiment, where the handle portion 30 is removably engaged with the collar portion 28 (FIG. 1), the handle portion 30 provides an engagement shaft 58 positioned and configured for being selectively inserted into a corresponding engagement socket 60 provided by the collar portion 28. In at least one embodiment, the engagement socket 60 is oriented in a direction orthogonal to the collar channel 42 of the collar portion 28. In at least one such embodiment, the engagement socket 60 is positioned on one of the first collar half 32 or second collar half 34. In at least one embodiment, where each of the at least one locking mechanism 48 is positioned on the same one of the first collar half 32 and second collar half 34, the engagement socket 60 may also be positioned on the same one of the first collar half 32 and second collar half 34 as the at least one locking mechanism 48. In at least one alternate embodiment (not illustrated), the first collar half 32 and second collar half 34 cooperate to define the engagement socket 60 therebetween when the collar portion 28 is in the closed position. Thus, in at least one embodiment, the engagement shaft 58 has an outer diameter that is relatively smaller than an inner diameter of the engagement socket 60. In at least one embodiment, an outer surface 62 of the engagement shaft 58 and an inner surface 64 of the engagement socket 60 provide complementary keyed surfaces configured for ensuring proper alignment between the handle portion 30 and the collar portion 28 when the engagement shaft 58 is inserted into the engagement socket 60, and also for maintaining an alignment such that the engagement shaft 58 does not rotate relative to the engagement socket 60 during use of the apparatus 20. In at least one such embodiment, the outer surface 62 of the engagement shaft 58 provides an at least one linear alignment tongue 66 positioned and configured for riding within a corresponding linear alignment groove 68 positioned on the inner surface 64 of the engagement socket 60. In further embodiments, any other mechanism (now known or later developed) capable of ensuring proper alignment between the handle portion 30 and the collar portion 28 may be substituted. Additionally, in at least one such embodiment, provided on the engagement shaft 58 is a locking ring 70 configured for being selectively threadably engaged with an outer surface 72 of the engagement socket 60 when the engagement shaft 58 is positioned therewithin, thereby assisting to prevent the engagement shaft 58 from becoming unintentionally disengaged from the engagement socket 60 during use of the apparatus 20. In at least one alternate embodiment, the locking ring 70 is provided by the engagement socket 60 rather than the engagement shaft 58. In further embodiments, any other mechanism (now known or later developed) capable of removably engaging the handle portion 30 with the collar portion 28 may be substituted.

In at least one embodiment, the handle portion 30 is constructed out of one or more of plastic, rubber and metal materials. Additionally, in at least one embodiment, an outer surface of the handle portion 30 is covered with a high-density foam material. In further embodiments, the handle portion 30 may be constructed out of any other materials (now known or later developed) so long as the apparatus 20 is capable of substantially carrying out the functionality described herein. In at least one embodiment, as illustrated in FIGS. 1 and 9-12, a grip portion 74 of the handle portion 30 is configured as a continuous loop, similar to the portion of a traditional kettlebell handle that a user engages with, thereby allowing the apparatus 20 to be used in performing exercises for which kettlebells are traditionally used.

In at least one such embodiment, the grip portion 74 of the handle portion 30 is selectively rotatable about the engagement shaft 58, thereby allowing the handle portion 30 to move between one of a first rotational orientation (FIG. 10)—wherein the grip portion 74 is oriented in a plane substantially parallel with the collar channel 42 of the collar portion 28 (along with the bar portion 24 of the free weight 22)—and a second rotational orientation (FIG. 11)—wherein the grip portion 74 is oriented in a plane substantially transverse or orthogonal to the collar channel 42 of the collar portion 28 (along with the bar portion 24 of the free weight 22). This, in turn, allows the apparatus 20 to be used in performing a relatively wider variety of exercises for which kettlebells are traditionally used. In further embodiments, the handle portion 30 may be configured for selectively moving into any other rotational orientations relative to the collar channel 42 of the collar portion 28 (along with the bar portion 24 of the free weight 22)—dependent at least in part on the context in which the apparatus 20 is to be used—so long as the apparatus 20 is capable of substantially carrying out the functionality described herein.

Figure 12:
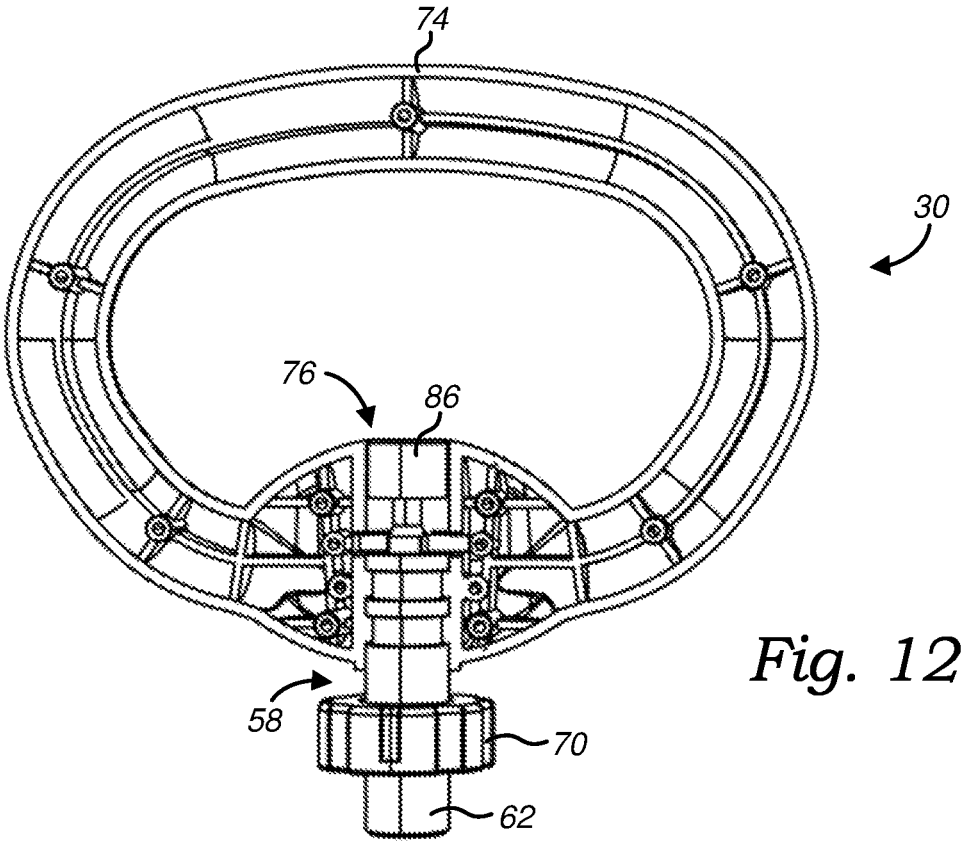
FIG. 12 is perspective view of the handle portion of the apparatus, with a portion thereof omitted for illustrative purposes, in accordance with at least one embodiment.
Figure 13:
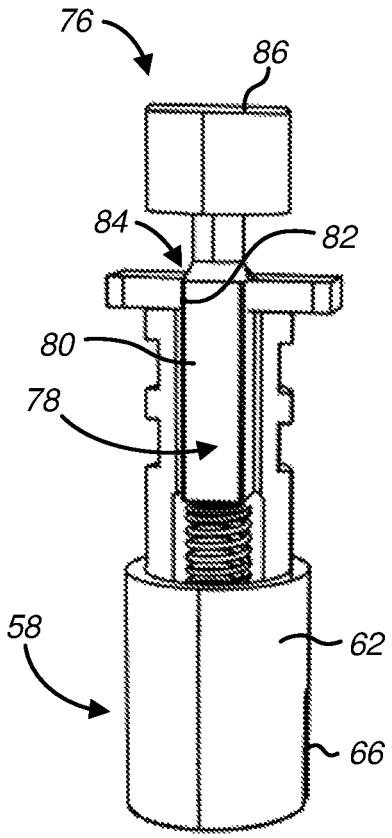
FIG. 13 is a perspective view of an engagement shaft of the handle portion, with a portion thereof omitted for illustrative purposes, in accordance with at least one embodiment.

In at least one embodiment, the handle portion 30 provides a rotational lock 76 configured for assisting to prevent the grip portion 74 from unintentionally moving out of its current rotational orientation (i.e., relative to the collar channel 42 and bar portion 24) during use of the apparatus 20. In at least one such embodiment, as best illustrated in FIGS. 12 and 13, the rotational lock 76 is positioned within the engagement shaft 58 and provides a lock pin 78 having a keyed outer surface 80 positioned and configured for engaging an inner surface 82 of a corresponding lock aperture 84, thereby preventing the lock pin 78—and, in turn, the grip portion 74—from rotating when the lock pin 78 is coaxially positioned within and engaged with the lock aperture 84. Additionally, in at least one such embodiment, the lock pin 78 is spring-biased, with a terminal end of the lock pin 78 providing a lock button 86 that is accessible external to the handle portion 30. Accordingly, upon the lock button 86 being manually depressed, the lock pin 78 is temporarily moved out of abutting contact with the inner surface of the lock aperture 84, thereby allowing the lock pin 78—and, in turn, the grip portion 74—to selectively rotate about the engagement shaft 58. Once the lock button 86 is no longer depressed, the lock pin 78 is biased back into substantially abutting contact with the inner surface 82 of the lock aperture 84, thereby once again preventing the lock pin 78—and, in turn, the grip portion 74 of the handle portion 30—from rotating. In further embodiments, any other mechanism (now known or later developed) capable of preventing the grip portion 74 of the handle portion 30 from unintentionally moving out of its current rotational orientation during use of the apparatus 20 may be substituted.

Figure 14:
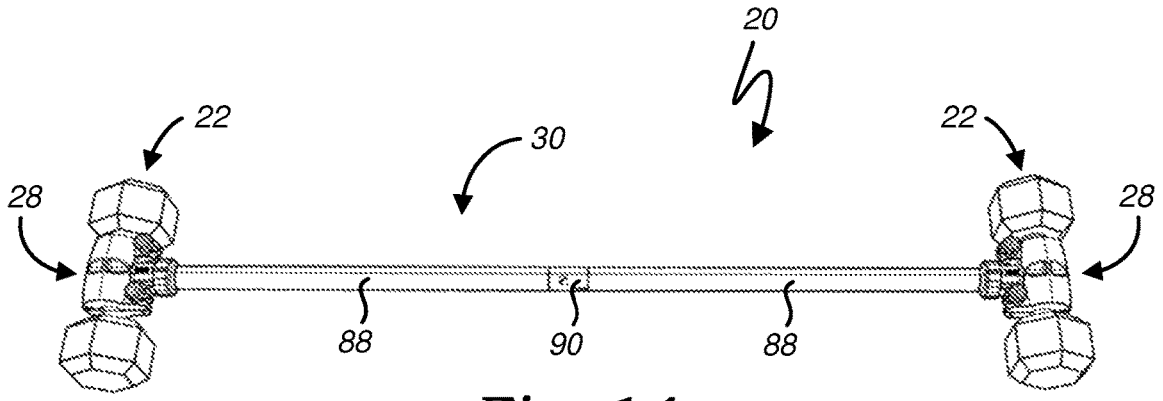
FIG. 14 is a perspective view of a further exemplary modular free weight apparatus, in accordance with at least one embodiment.
Figure 15:
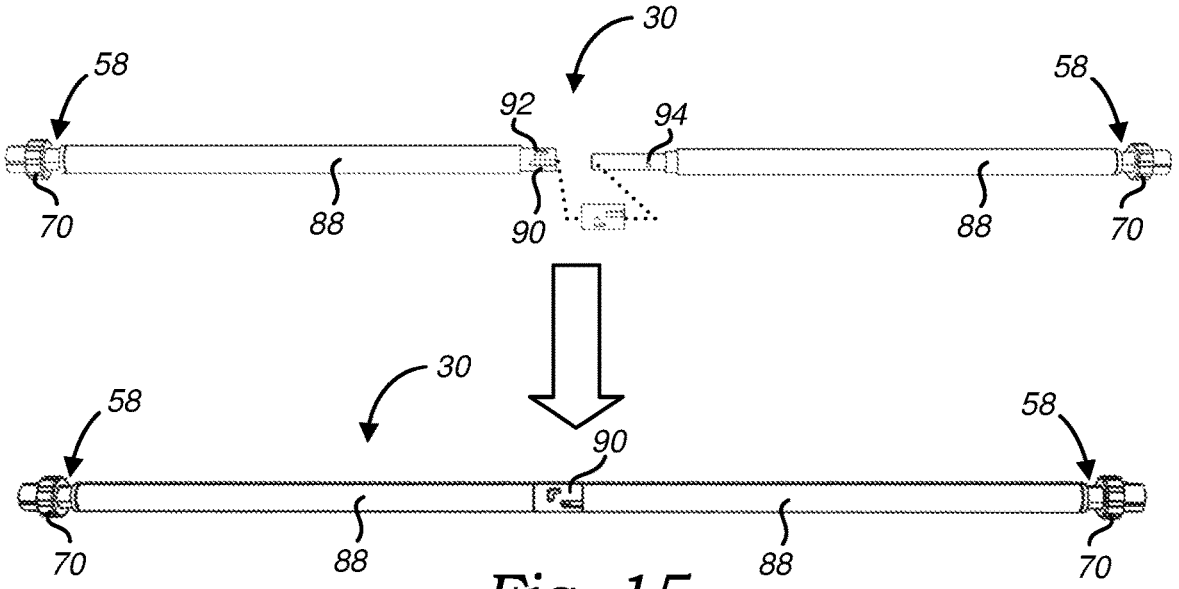
FIG. 15 is an exploded view of an exemplary handle portion of the apparatus depicted in FIG. 14, in accordance with at least one embodiment.

In at least one alternate embodiment, as illustrated in FIGS. 14 and 15, the grip portion 74 of the handle portion 30 is configured as an elongate bar, similar to that of a traditional barbell. In at least one such embodiment, the handle portion 30 provides a pair of opposing engagement shafts 58 positioned at opposing terminal ends of the grip portion 74, thereby allowing a corresponding pair of collar portions 28 to be engaged (removably or permanently) therewith, which allows the apparatus 20 to be used in performing exercises for which barbells are traditionally used. In at least one further alternate embodiment, the handle portion 30 provides a single engagement shaft 58 positioned at one of the terminal ends of the grip portion 74, which allows the apparatus 20 to be used in performing exercises for which sledgehammer-like equipment is traditionally used. In at least one embodiment, the handle portion 30 is of unitary construction. In at least one alternate embodiment, as illustrated in FIG. 15, the handle portion 30 comprises a pair of elongate handle segments 88 that are removably engaged with one another via a segment connector 90. In at least one such embodiment, the segment connector 90 comprises a J-shaped connector slot 92 provided by a first one of the handle segments 88 configured for slidably receiving a corresponding connector pin 94 provided by a second one of the handle segments 88. Additionally, in at least one such embodiment, the first one of the handle segments 88 provides an internal spring (not shown) positioned and configured for urging the handle segments 88 apart, thereby assisting in preventing the connector pin 94 from unintentionally moving out of the J-shaped connector slot 92 during use of the apparatus 20. In further embodiments, any other mechanism (now known or later developed) capable of removably engaging the handle segments 88 with one another may be substituted.

Again, as noted above, in further embodiments, the handle portion 30 may take on any other sizes, shapes, dimensions and/or configurations now known or later developed—dependent at least in part on the context in which the apparatus 20 is to be used—so long as the apparatus 20 is capable of substantially carrying out the functionality described herein. Additionally, where the handle portion 30 is configured for removable engagement with the at least one collar portion 28, the same collar portion 28 may be used in combination with a variety of different handle portions 30 (i.e., loop-shaped grip portion 74, bar-shaped grip portion 74, etc.), given that the engagement shaft 58 of each such handle portion 30 is configured for engagement with the engagement socket 60 of the same collar portion 28.

Figure 16:
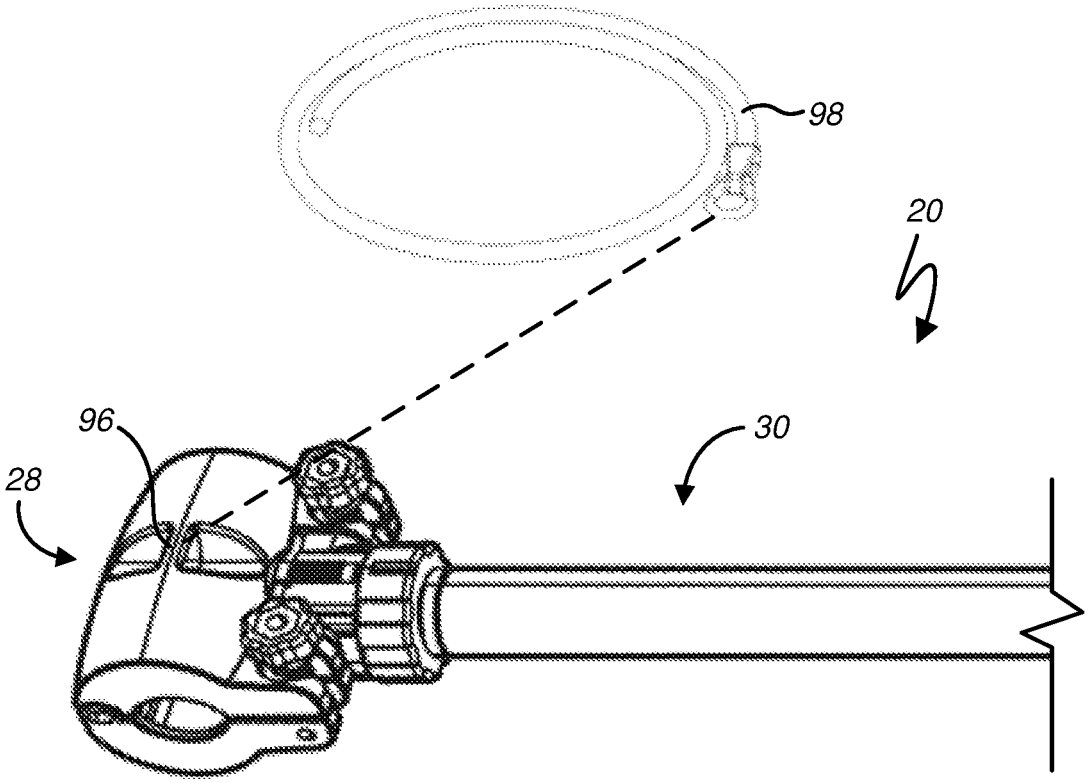
FIG. 16 is a partial perspective view of the apparatus depicted in FIG. 14, in accordance with at least one embodiment.

In at least one embodiment, as best illustrated in FIG. 16, the collar portion 28 provides an at least one attachment point 96 configured for removable engagement with a resistance tube, resistance band, or other type of resistance device (hereinafter collectively referred to as a "resistance device" 98 for simplicity purposes). The attachment point 96 may be a hook, carabiner, or any other structure or mechanism, now known or later developed, capable of removable engagement with the resistance device 98. In at least one alternate embodiment, the resistance device 98 is permanently secured to the attachment point 96. Accordingly, in at least one embodiment, such resistance device 98 may be positioned on the ground (or a similar surface with an appropriate amount of weight placed on the resistance device 98 (e.g. placing at least one foot on the resistance device 98) to prevent the resistance device 98 from unintentionally moving out of position on the ground, and the respectively handle portion 30 that is engaged with the collar portion 28 may then be grasped and used in performing exercises for which resistance devices 98 are traditionally used. Alternatively, the apparatus 20 may be positioned on the ground (or a similar surface) with an appropriate amount of weight placed on the apparatus 20 (e.g., placing at least one foot on the apparatus 20, engaging a heavy free weight 22 with the collar portion 28, etc.) to prevent the apparatus 20 from unintentionally moving out of position on the ground, and the resistance device 98 may then be grasped and used in performing exercises for which resistance devices 98 are traditionally used.

Aspects of the present specification may also be described as the following embodiments:

1. A modular free weight apparatus configured for being removably engageable with at least one free weight, the apparatus comprising: at least one collar portion, each collar portion comprising a first collar half and a second collar half, the first collar half hingedly engaged with the second collar half via an at least one collar hinge, thereby allowing the second collar half to pivot relative to the first collar half for selectively moving between one of an open position—wherein a free edge of the second collar half is pivoted away from a corresponding free edge of the first collar half—and a closed position—wherein the free edge of the second collar half is pivoted into substantially abutting contact with the corresponding free edge of the first collar half, each collar portion further comprising an engagement socket; the first collar half and second collar half cooperate to define a substantially tubular collar channel extending longitudinally through the collar portion when the collar portion is in the closed position.

2. The modular free weight apparatus according to embodiment 1, further comprising a handle portion comprising a grip portion and an at least one engagement shaft, each engagement shaft configured for engagement with the engagement socket of one of the at least one collar portion.

3. The modular free weight apparatus according to embodiments 1-2, wherein the at least one collar portion further comprises a locking mechanism pivotally engaged with one of the first collar half and the second collar half, the locking mechanism configured for preventing the collar portion from unintentionally moving out of the closed position.

4. The modular free weight apparatus according to embodiments 1-3, wherein the collar channel has an inner diameter that is substantially the same as or relatively larger than an outer diameter of the bar portion of the at least one free weight.

5. The modular free weight apparatus according to embodiments 1-4, wherein the collar channel has a length that is relatively shorter than a length of the bar portion of the at least one free weight.

6. The modular free weight apparatus according to embodiments 1-5, wherein the at least one collar hinge is configured for allowing the inner diameter of the collar channel to be selectively adjustable so as to accommodate a range of different free weights having bar portions of varying outer diameters.

7. The modular free weight apparatus according to embodiments 1-6, wherein: the at least one collar hinge provides an at least one elongate hinge slot through which a corresponding hinge pin transversely extends, such that the second collar half pivots about the hinge pin; and the hinge pin is capable of slidably moving along a length of the hinge slot which, in turn, moves a pivot point for the second collar half relative to the first collar half, thereby altering the inner diameter of the collar channel when the collar portion is moved into the closed position.

8. The modular free weight apparatus according to embodiments 1-7, wherein the at least one locking mechanism is a latch pivotally engaged with one of the first collar half and second collar half, the latch configured for selectively pivoting into a corresponding slot provided by the other of the first collar half and second collar half when the collar portion is in the closed position, thereby maintaining the free edge of the second collar half in substantially abutting contact with the corresponding free edge of the first collar half.

9. The modular free weight apparatus according to embodiments 1-8, wherein a terminal end of the latch provides a threadably engaged tightening knob configured for being selectively tightened against the corresponding slot when the latch is positioned therewithin, thereby assisting to prevent the latch from becoming unintentionally disengaged from the slot during use of the apparatus.

10. The modular free weight apparatus according to embodiments 1-9, wherein the at least one collar portion is constructed out of one or more of plastic, rubber and metal materials.

11. The modular free weight apparatus according to embodiments 1-10, wherein the handle portion is constructed out of one or more of plastic, rubber, and metal materials.

12. The modular free weight apparatus according to embodiments 1-11, wherein an outer surface of the handle portion is covered with a high-density foam material.

13. The modular free weight apparatus according to embodiments 1-12, wherein an inner surface of the collar channel provides a durable, high-friction material configured for creating a more secure engagement between the collar channel and the handle portion of the at least one free weight.

14. The modular free weight apparatus according to embodiments 1-13, wherein the handle portion is removably engageable with the at least one collar portion, the handle portion providing an engagement shaft positioned and configured for being selectively inserted into the engagement socket provided by the corresponding one of the at least one collar portion.

15. The modular free weight apparatus according to embodiments 1-14, wherein an outer surface of the engagement shaft and an inner surface of the engagement socket provide complementary keyed surfaces configured for ensuring proper alignment between the handle portion and the collar portion when the engagement shaft is positioned within the engagement socket.

16. The modular free weight apparatus according to embodiments 1-15, wherein the outer surface of the engagement shaft provides an at least one linear alignment tongue positioned and configured for riding within a corresponding linear alignment groove positioned on the inner surface of the engagement socket.

17. The modular free weight apparatus according to embodiments 1-16, wherein the engagement shaft provides a locking ring configured for being selectively threadably engaged with an outer surface of the engagement socket when the engagement shaft is positioned therewithin, thereby retaining the engagement shaft within the engagement socket.

18. The modular free weight apparatus according to embodiments 1-17, wherein the engagement socket provides a locking ring configured for being selectively threadably engaged with an outer surface of the engagement socket when the engagement shaft is positioned therewithin, thereby retaining the engagement shaft within the engagement socket.

19. The modular free weight apparatus according to embodiments 1-18, wherein the grip portion of the handle portion is configured as a continuous loop.

20. The modular free weight apparatus according to embodiments 1-19, wherein the grip portion of the handle portion is selectively rotatable about the engagement shaft, relative to the at least one collar portion, such that the handle portion is capable of selectively moving between one of a first rotational orientation—wherein the grip portion is oriented in a plane substantially parallel with the collar channel of the at least one collar portion—and a second rotational orientation—wherein the grip portion is oriented in a plane substantially transverse to the collar channel of the collar portion.

21. The modular free weight apparatus according to embodiments 1-20, wherein the handle portion provides a rotational lock configured for assisting to prevent the grip portion from unintentionally rotating relative to the at least one collar portion.

22. The modular free weight apparatus according to embodiments 1-21, wherein: the rotational lock is positioned within the engagement shaft and provides a lock pin having a keyed outer surface configured for engaging an inner surface of a corresponding lock aperture, thereby preventing the lock pin—and, in turn, the grip portion—from rotating when the lock pin is coaxially positioned within and engaged with the lock aperture; and the lock pin is spring-biased, with a terminal end of the lock pin providing a lock button that is accessible external to the handle portion; whereby, upon the lock button being manually depressed, the lock pin is temporarily moved out of abutting contact with the inner surface of the lock aperture, thereby allowing the lock pin—and, in turn, the grip portion—to selectively rotate about the engagement shaft.

23. The modular free weight apparatus according to embodiments 1-22, wherein the grip portion of the handle portion is configured as an elongate bar.

24. The modular free weight apparatus according to embodiments 1-23, wherein: the handle portion provides a pair of opposing engagement shafts positioned at opposing terminal ends of the grip portion; and each of the engagement shafts is configured for engagement with a collar portion.

25. The modular free weight apparatus according to embodiments 1-24, wherein the handle portion comprises a pair of elongate handle segments removably engaged with one another via a segment connector.

26. The modular free weight apparatus according to embodiments 1-25, wherein: the segment connector comprises a J-shaped connector slot provided by a first one of the handle segments, the connector slot configured for slidably receiving a corresponding connector pin provided by a second one of the handle segments; the first one of the handle segments provides an internal spring positioned and configured for urging the handle segments apart, thereby assisting in preventing the connector pin from unintentionally moving out of the J-shaped connector slot during use of the apparatus.

27. The modular free weight apparatus according to embodiments 1-26, wherein the at least one collar portion provides an at least one attachment point configured for engagement with a resistance device.

28. A modular free weight apparatus configured for being removably engageable with an at least one free weight, the apparatus comprising: an at least one collar portion sized and configured for removable engagement about an elongate bar portion of the at least one free weight, the collar portion providing a first collar half hingedly engaged with an opposing second collar half via an at least one collar hinge, thereby allowing the second collar half to pivot relative to the first collar half for selectively moving between one of an open position—wherein a free edge of the second collar half is pivoted away from a corresponding free edge of the first collar half—and a closed position—wherein the free edge of the second collar half is pivoted into substantially abutting contact with the corresponding free edge of the first collar half; the first collar half and second collar half cooperating to define a substantially tubular collar channel extending longitudinally through the collar portion when the collar portion is in the closed position, the collar channel sized and configured for removably receiving the bar portion of the at least one free weight therewithin; and the at least one collar hinge providing an at least one elongate hinge slot through which a corresponding hinge pin transversely extends, such that the second collar half pivots about the hinge pin, the hinge pin configured for slidably moving along a length of the hinge slot which, in turn, moves a pivot point for the second collar half relative to the first collar half, thereby altering an inner diameter of the collar channel when the collar portion is moved into the closed position.

29. A modular free weight apparatus configured for being removably engageable with an at least one free weight, the apparatus comprising: an at least one collar portion sized and configured for removable engagement about an elongate bar portion of the at least one free weight, the collar portion providing a first collar half hingedly engaged with an opposing second collar half via an at least one collar hinge, thereby allowing the second collar half to pivot relative to the first collar half for selectively moving between one of an open position—wherein a free edge of the second collar half is pivoted away from a corresponding free edge of the first collar half—and a closed position—wherein the free edge of the second collar half is pivoted into substantially abutting contact with the corresponding free edge of the first collar half; the first collar half and second collar half cooperating to define a substantially tubular collar channel extending longitudinally through the collar portion when the collar portion is in the closed position, the collar channel sized and configured for removably receiving the bar portion of the at least one free weight therewithin; and the at least one collar portion further providing an at least one locking mechanism configured for preventing the collar portion from unintentionally moving out of the closed position; a handle portion providing a grip portion and an at least one engagement shaft positioned and configured for being selectively inserted into a corresponding engagement socket provided by the at least one collar portion.

In closing, regarding the exemplary embodiments of the present invention as shown and described herein, it will be appreciated that a modular weight apparatus is disclosed and configured for being removably engageable with an at least one free weight for allowing a user to engage in a wide variety of fitness-related exercises. Because the principles of the invention may be practiced in a number of configurations beyond those shown and described, it is to be understood that the invention is not in any way limited by the exemplary embodiments, but is generally directed to a modular weight apparatus and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the terms "about" and "approximately." As used herein, the terms "about" and "approximately" mean that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein. Similarly, as used herein, unless indicated to the contrary, the term "substantially" is a term of degree intended to indicate an approximation of the characteristic, item, quantity, parameter, property, or term so qualified, encompassing a range that can be understood and construed by those of ordinary skill in the art, or at least encompassing a range of plus or minus ten percent above and below the value of the stated characteristic, item, quantity, parameter, property, or term.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, embodiments described herein or so claimed with the phrase "comprising" are expressly or inherently unambiguously described, enabled, and supported herein for the phrases "consisting essentially of" and "consisting of."

Any claims intended to be treated under 35 U.S.C. § 112(f) will begin with the words "means for," but use of the term "for" in any other context is not intended to invoke treatment under 35 U.S.C. § 112(f). Accordingly, Applicant reserves the right to pursue additional claims after filing this application, in either this application or in a continuing application.

It should be understood that any methods disclosed herein, along with the order in which the respective elements of any such method are performed, are purely exemplary. Depending on the implementation, they may be performed in any order or in parallel, unless indicated otherwise in the present disclosure.

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents are based on the information available to the applicants and do not constitute any admission as to the correctness of the dates or contents of these documents.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor (s) believe that the claimed subject matter is the invention.

What is claimed is:

1. A modular free weight apparatus configured for being removably engageable with a free weight, the apparatus comprising:

at least one collar portion, each of the at least one collar portion comprising a first collar half and a second collar half, the first collar half hingedly engaged with the second collar half via an at least one collar hinge, thereby allowing the second collar half to pivot relative to the first collar half for selectively moving between one of an open position—wherein a free edge of the second collar half is pivoted away from a corresponding free edge of the first collar half—and a closed position—wherein the free edge of the second collar half is pivoted into substantially abutting contact with the corresponding free edge of the first collar half, one of the first collar half and the second collar half comprising a cylindrical engagement socket having an outer threaded surface, wherein the first collar half and the second collar half cooperate to define a substantially tubular collar channel extending longitudinally through one of the at least one collar portion when the one of the at least one collar portion is in the closed position.

2. The modular free weight apparatus of claim 1, further comprising a handle portion comprising a grip portion and an at least one engagement shaft, each engagement shaft configured for engagement with the cylindrical engagement socket of one of the at least one collar portion.

3. The modular free weight apparatus of claim 2, wherein the handle portion is removably engageable with the at least one collar portion, the handle portion providing an engagement shaft positioned and configured for being selectively inserted into the cylindrical engagement socket provided by the corresponding one of the at least one collar portion.

4. The modular free weight apparatus of claim 3, wherein an outer surface of the engagement shaft and an inner surface of the cylindrical engagement socket provide complementary keyed surfaces configured for ensuring proper alignment between the handle portion and the corresponding one of the at least one collar portion when the engagement shaft is positioned within the cylindrical engagement socket.

5. The modular free weight apparatus of claim 3, wherein the engagement shaft provides a locking ring configured for being selectively threadably engaged with an outer surface of the cylindrical engagement socket when the engagement shaft is positioned therewithin, thereby retaining the engagement shaft within the cylindrical engagement socket.

6. The modular free weight apparatus of claim 2, wherein the grip portion of the handle portion is configured as a continuous loop.

7. The modular free weight apparatus of claim 2, wherein the grip portion of the handle portion is selectively rotatable about the engagement shaft, relative to the at least one collar portion, such that the handle portion is capable of selectively moving between one of a first rotational orientation—wherein the grip portion of the handle portion is oriented in a plane substantially parallel with the substantially tubular collar channel of the at least one collar portion—and a second rotational orientation—wherein the grip portion of the handle portion is oriented in a plane substantially transverse to the substantially tubular collar channel of the at least one collar portion.

8. The modular free weight apparatus of claim 7, wherein the handle portion provides a rotational lock configured for assisting to prevent the grip portion of the handle portion from unintentionally rotating relative to the at least one collar portion.

9. The modular free weight apparatus of claim 8, wherein:

the rotational lock is positioned within the engagement shaft and provides a lock pin having a keyed outer surface configured for engaging an inner surface of a corresponding lock aperture, thereby preventing the lock pin—and, in turn, the grip portion of the handle portion—from rotating when the lock pin is coaxially positioned within and engaged with a lock aperture; and the lock pin is spring-biased, with a terminal end of the lock pin providing a lock button that is accessible external to the handle portion;

whereby, upon the lock button being manually depressed, the lock pin is temporarily moved out of abutting contact with the inner surface of the lock aperture, thereby allowing the lock pin—and, in turn, the grip portion of the handle portion—to selectively rotate about the engagement shaft.

10. The modular free weight apparatus of claim 2, wherein the grip portion of the handle portion is configured as an elongate bar.

11. The modular free weight apparatus of claim 10, wherein:

the handle portion provides a pair of opposing engagement shafts positioned at opposing terminal ends of the grip portion of the handle portion; and each engagement shaft of the pair of opposing engagement shafts is configured for engagement with a collar portion.

12. The modular free weight apparatus of claim 10, wherein the handle portion comprises a pair of elongate handle segments removably engaged with one another via a segment connector.

13. The modular free weight apparatus of claim 12, wherein:

the segment connector comprises a J-shaped connector slot provided by a first one of the pair of elongate handle segments, the J-shaped connector slot configured for slidably receiving a corresponding connector pin provided by a second one of the pair of elongate handle segments; and the first one of the pair of elongate handle segments provides an internal spring positioned and configured for urging the pair of elongate handle segments apart, thereby assisting in preventing the corresponding connector pin from unintentionally moving out of the J-shaped connector slot during use of the apparatus.

14. The modular free weight apparatus of claim 1, wherein each of the at least one collar portion further comprises a locking mechanism pivotally engaged with one of the first collar half and the second collar half, the locking mechanism configured for preventing the respective collar portion from unintentionally moving out of the closed position.

15. The modular free weight apparatus of claim 14, wherein the locking mechanism is a latch pivotally engaged with one of the first collar half and the second collar half, the latch configured for selectively pivoting into a corresponding slot provided by the other of the first collar half and the second collar half when the respective collar portion is in the closed position, thereby maintaining the free edge of the second collar half in substantially abutting contact with the corresponding free edge of the first collar half.

16. The modular free weight apparatus of claim 15, wherein a terminal end of the latch provides a threadably engaged tightening knob configured for being selectively tightened against the corresponding slot when the latch is positioned therewithin, thereby assisting to prevent the latch from becoming unintentionally disengaged from the corresponding slot during use of the apparatus.

17. The modular free weight apparatus of claim 1, wherein the at least one collar hinge is configured for allowing an inner diameter of the collar channel to be selectively adjustable so as to accommodate a range of different free weights having bar portions of varying outer diameters.

18. The modular free weight apparatus of claim 17, wherein:

each of the at least one collar hinge provides an at least one elongate hinge slot through which a corresponding hinge pin transversely extends, such that the second collar half pivots about the corresponding hinge pin; and the corresponding hinge pin is capable of slidably moving along a length of the at least one elongate hinge slot which, in turn, moves a pivot point for the second collar half relative to the first collar half, thereby altering the inner diameter of the substantially tubular collar channel when the respective collar portion is moved into the closed position.

* * * * *